US010731513B2

(12) United States Patent
Mousavi

(10) Patent No.: US 10,731,513 B2
(45) Date of Patent: Aug. 4, 2020

(54) COMPACT MULTI-STAGE CONDENSER DUMP DEVICE

(71) Applicant: Control Components, Inc., Rancho Santa Margarita, CA (US)

(72) Inventor: Poopak Mousavi, Rancho Santa Margarita, CA (US)

(73) Assignee: CONTROL COMPONENTS, INC., Rancho Santa Margarita, CA (US)

( * ) Notice: Subject to any disclaimer, the term of this patent is extended or adjusted under 35 U.S.C. 154(b) by 259 days.

(21) Appl. No.: 15/438,394

(22) Filed: Feb. 21, 2017

(65) Prior Publication Data

US 2018/0216891 A1 Aug. 2, 2018

Related U.S. Application Data

(60) Provisional application No. 62/452,849, filed on Jan. 31, 2017.

(51) Int. Cl.

| | |
|---|---|
| ***F01K 9/00*** | (2006.01) |
| ***F28B 1/06*** | (2006.01) |
| ***F28F 9/02*** | (2006.01) |
| ***F28B 9/02*** | (2006.01) |

(52) U.S. Cl.

CPC ..... *F01K 9/003* (2013.01); *F28B 1/06* (2013.01); *F28B 9/02* (2013.01); *F28F 9/028* (2013.01); *F28F 9/0278* (2013.01); *F28F 2265/28* (2013.01)

(58) Field of Classification Search

CPC .... F01K 9/003; F28B 1/06; F28B 9/02; F28F 9/0278; F28F 9/028; F28F 2265/28

See application file for complete search history.

(56) References Cited

U.S. PATENT DOCUMENTS

| | | | | | |
|---|---|---|---|---|---|
| 675,830 | A * | 6/1901 | Gray | F01N 1/08 | 181/267 |
| 1,473,449 | A * | 11/1923 | Stearns | F28B 3/04 | 261/115 |
| 3,070,157 | A * | 12/1962 | Droescher | F22D 3/00 | 165/159 |
| 3,635,309 | A * | 1/1972 | Nemcansky | F01B 31/16 | 181/267 |
| 4,072,170 | A * | 2/1978 | Sagner | F01B 31/16 | 137/599.01 |

(Continued)

FOREIGN PATENT DOCUMENTS

| | | |
|---|---|---|
| CN | 2224287 Y | 4/1996 |
| CN | 203642154 U | 6/2014 |
| KR | 101398101 B1 | 5/2014 |

OTHER PUBLICATIONS

International Search Report and Written Opinion for PCT/US2018/015781; dated Apr. 5, 2018.

*Primary Examiner* — Matthew T Largi

(74) *Attorney, Agent, or Firm* — Stetina Brunda Garred and Brucker; Mark B. Garred

(57) ABSTRACT

A multi-stage, torispherical drilled-hole dump device which mounts on the surface of an air cooled condenser (ACC) duct, and provides a compact and lightweight method for discharging steam into the duct by presenting a large surface area which minimizes noise and vibration, while also having a low-profile shape which minimizes projection into the duct and flow disturbance in the duct.

18 Claims, 10 Drawing Sheets

(56) References Cited

U.S. PATENT DOCUMENTS

| | | | | |
|---|---|---|---|---|
| 6,189,871 | B1 * | 2/2001 | Schlageter | F01K 3/002 261/118 |
| 6,481,208 | B1 * | 11/2002 | Nadig | F01B 31/06 60/687 |
| 7,044,437 | B1 | 5/2006 | Martin | |
| 7,055,324 | B2 | 6/2006 | DePenning et al. | |
| 7,604,021 | B2 | 10/2009 | Ootomo et al. | |
| 7,866,441 | B2 * | 1/2011 | Catron | B01F 5/0453 181/224 |
| 2014/0224369 | A1 * | 8/2014 | Taylor | F01B 31/16 138/41 |
| 2015/0330260 | A1 * | 11/2015 | Bapat | F01K 17/04 60/653 |
| 2016/0169053 | A1 * | 6/2016 | Deister | F01K 9/04 60/690 |
| 2016/0363314 | A1 * | 12/2016 | Seiller | F01K 9/003 |

* cited by examiner

COMPACT MULTI-STAGE CONDENSER DUMP DEVICE

CROSS-REFERENCE TO RELATED APPLICATIONS

The present application claims priority to U.S. Provisional Application Ser. No. 62/452,849 entitled COMPACT MULTI-STAGE CONDENSER DUMP DEVICE filed Jan. 31, 2017.

STATEMENT RE: FEDERALLY SPONSORED RESEARCH/DEVELOPMENT

Not Applicable

BACKGROUND

1. Technical Field

The present disclosure relates generally to noise attenuation devices and, more particularly, to a multi-stage (e.g., two-stage), torispherical drilled-hole dump device which mounts on the surface of an air cooled condenser (ACC) duct, and provides a compact and lightweight method for discharging steam into the duct by presenting a large surface area which minimizes noise and vibration, while also having a low-profile shape which minimizes projection into the duct and flow disturbance in the duct.

2. Description of the Related Art

In a power plant with an air cooled condenser (ACC), steam is carried from the steam turbine exhaust to the condenser via a large, thin, wall, uninsulated duct. Noise sources that discharge into the ACC duct have much less attenuation than in a water-cooled condenser. The ACC duct is typically external to the turbine building and has a very large surface area. High noise levels at the ACC duct surface can generate unacceptable noise levels at the plant boundary and in neighboring communities.

This problem is especially important in combined cycle power stations. Combined cycle power stations have 100% turbine bypass systems. The combined steam flow and desuperheater cooling flow from the bypass system discharges nearly 50% more mass flow into the duct than the steam turbine, and at a higher enthalpy. This large amount of mass flow is typically discharged into a dump device that is much smaller than the steam turbine exhaust, concentrating noise energy into a very small area. Single-stage control valves and dump elements can generate external noise levels in excess of 130 dBA at a distance of 1 m from the ACC duct surface, and 75 dBA up to a kilometer from the plant. With many combined cycle plants on a daily cycling, start-up noise can become a severe constraint in plant operation.

Combined cycle power stations are also relatively compact, and are much more likely to be sited in a sensitive environment than a large coal-fired boiler. Plants with extensive noise levels may face financial penalties, and in some cases, suspension of plant operation. Due to the large size of the ACC duct, traditional noise treatment methods like acoustic enclosures or insulation are impractical or insufficient. The source noise must be treated in order to meet plant noise requirements.

The noise from the bypass system comes from two primary sources, the steam bypass control valve and the final dump element that discharges all steam flow and spray water flow into the ACC duct. The sound power and peak frequency of each source must be controlled in order to reduce overall system noise. The dominant source in large power stations is the final dump element in the bypass to condenser systems.

One of the most common dump element designs feature a large array of drilled holes, typically 6 mm to 12 mm, densely packed on a flat, circular plate, an elliptical fish mouth device, or a dump tube. However, these designs can generate noise levels in excess of 130 dBA at a distance of 1 m from the ACC duct surface. The large amount of concentrated sound power creates vibration that can cause cracks in the duct walls and dump element mounting ring.

The prior art also includes traditional two-stage dump devices which are tubes where the dump holes are distributed on the walls of the tubes. To meet the required capacity, these two-stage dump tubes become so big that they block a considerable portion of the cross-section of the condenser duct. This blockage is undesirable, as it increases condenser pressure and consequently decreases plant efficiency since, i.e., dump tubes which project into the duct block flow and create backpressure on the dump tube. As the plant designer will typically strive to minimize the flow resistance within the duct, the maximum dump tube projection will typically be limited to 5%-7% of duct cross-sectional area. If the dump tube needs to be larger than this, then the dump tube can be mounted within a branch connection or "Bell housing" which sits perpendicular to the duct, i.e., the dump tube is housed outside of the condenser duct, in the Bell housing. The requirement for Bell housing is seen for most of the hot reheat (HRH) steam bypass to ACC condensers, where noise limitation is a concern. However, the Bell housings are relatively big, costly, and noisy. Also, dump tubes which are nested within a Bell housing also generate flow resistance caused by the interaction of the duct flow with the Bell housing.

The present dump device addresses the known deficiencies of the prior art described above. Along these lines, the shape of the present dump device provides a significant advantage on the ACC duct application, such shape providing a low profile which significantly minimizes blockage, and an elliptical cross section which minimizes drag or friction. These and other features and advantages of the dump device constructed in accordance with the present disclosure will be described in more detail below.

BRIEF SUMMARY

In accordance with the present disclosure, there is provided a multi-stage condenser dump device which may be used for dumping steam in a hot reheat (HRH) steam turbine bypass to air cooled condenser (ACC) application. Though the dump device design finds particular utility for bypass steam dump to ACC ducts, it can also be applied in other applications where high energy fluid must be discharged to very low pressure, including spargers inside large bore pipes and ducts and vent diffusers. The dump device is mounted to the walls of the duct using a flange. The flange provides an expansion joint which absorbs reaction loads from discharge, and does not translate bending loads directly into the shell of the duct.

The dump device is adapted to replace current two-stage dump devices and their Bell housings for ACC condensers, and generally comprises a compact, torispherical drilled-hole device which mounts on the surface of the duct. In this regard, the dump device provides a compact and lightweight method for discharging steam into the duct. The dump device has a large surface area which minimizes noise and vibration, and further has a low-profile shape which minimizes projection into the duct and flow disturbance therein.

In greater detail, in an exemplary embodiment, the dump device generally comprises two torispherical heads which are adapted to be installed directly at the condenser duct. The torispherical shapes provide a large face area, which allows for drilling holes on the face of each of these heads in sizes, shapes, patterns and arrangements as needed to satisfy and one of a multiplicity of different capacity requirements for the purpose of dumping steam to the ACC condenser. In this regard, the hole-pattern distribution on the first and second stages has an important impact on noise performance. Along these lines, the first stage and/or second stage may feature a blank area in the center. The blank area(s) can be used to prevent direct line of sight flow from the first stage to and through the second stage for the purposes of: (1) preventing jet recombination; and (2) lowering reaction forces. The holes are preferably drilled perpendicular to the curved surfaces of the first and second stages of the dump device. This diffuses the jets, improves distribution of energy into the duct, and minimizes noise, vibration, and reaction loads (lower load in the same plane).

Since pressure distribution between stages also has an important impact on performance, the dump device may be configured to have a Mach number less than 1 (e.g., preferably subsonic) at the first stage to reduce or eliminate noise or shock wave problems where the steam is inside the dump device, with the outer or second stage having a Mach more than 1 for space limitation. In this regard, the second stage is designed to limit average velocity across the surface of the dump device to an acceptable limit during normal and trip conditions. The limits will typically be around 0.5 Mach during normal operating conditions, and around transonic during trip. The velocity limit during normal operation is selected to reduce noise. The velocity limit during trip is selected to prevent excessive reaction loads.

While the primary embodiments of the dump device each employ a two-stage design which is the most common type, it is contemplated that the dump device design can include multiple stages. For example, a three-stage device could have three torispherical heads in series, with each successive head larger in size and discharge area.

The presently contemplated embodiments will be best understood by reference to the following detailed description when read in conjunction with the accompanying drawings.

BRIEF DESCRIPTION OF THE DRAWINGS

These, as well as other features of the present disclosure, will become more apparent upon reference to the drawings wherein.

Common reference numerals are used throughout the drawings and the detailed description to indicate the same elements.

DETAILED DESCRIPTION

Figure 1:
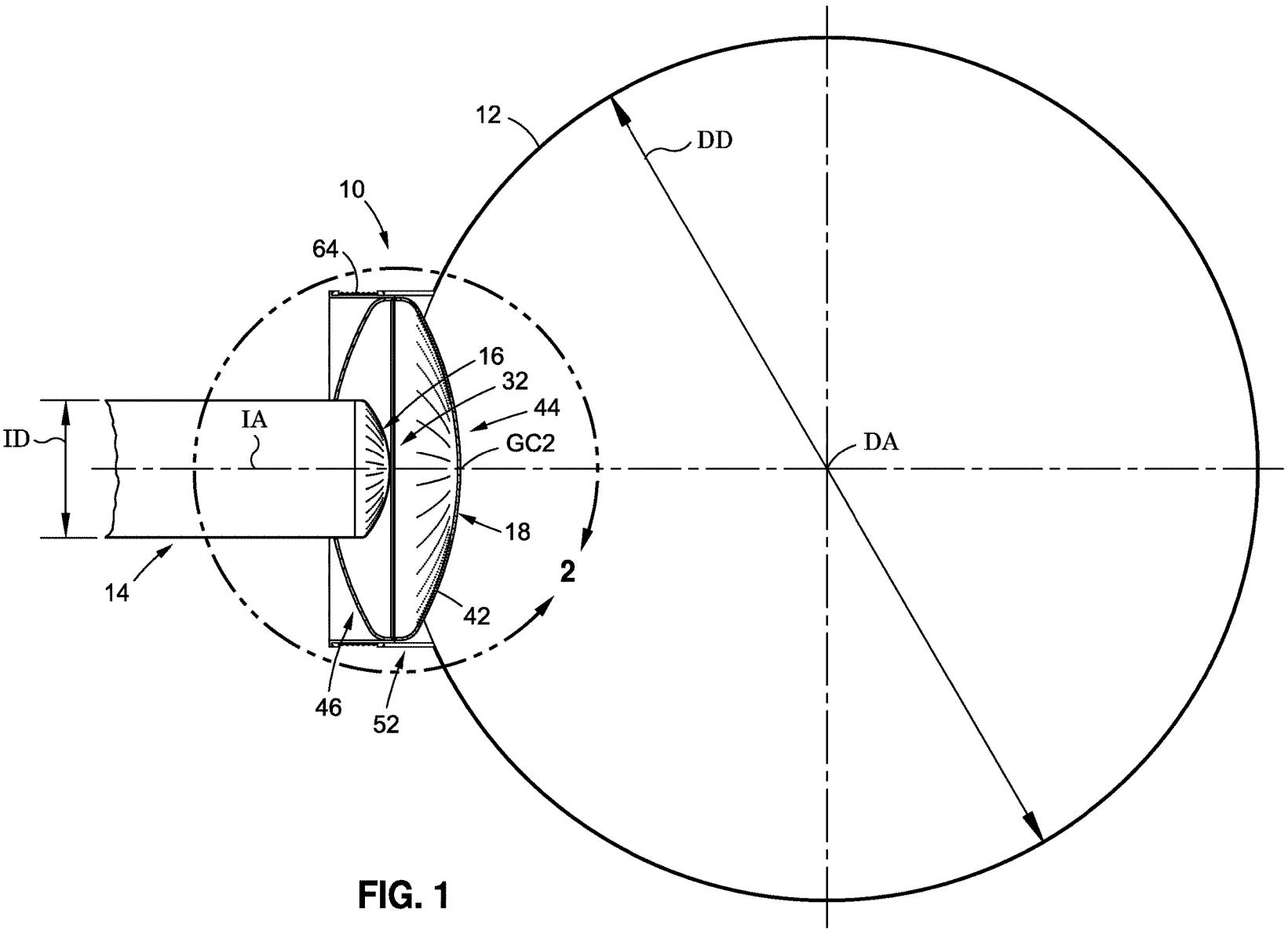
FIG. 1 is a partial cross-sectional view of a multi-stage condenser dump device constructed in accordance with a first embodiment of the present disclosure as operatively coupled to a condenser duct.

Referring now to the drawings wherein the showings are for purposes of illustrating preferred embodiments of the present disclosure only, and not for purposes of limiting the same, FIGS. 1-4 depict a dump device 10 constructed in accordance with a first embodiment of the present disclosure. The dump device 10 is particularly suited for operative integration between and mounting to a dump tube or duct 12 (e.g., an air cooled condenser duct) and a corresponding steam inlet pipe 14 as allows the dump device 10 to facilitate the discharge of steam from the steam inlet pipe 14 into the duct 12. As seen in FIG. 1, the duct 12 will typically be cylindrically configured, having a generally circular cross-sectional configuration and defining a duct axis DA, while further being provided with an inner duct diameter DD in the range of about 16 to 24 feet. Similarly, the steam inlet pipe 14 will typically be cylindrically configured, having a generally circular cross-sectional configuration and defining an inlet axis IA, while further being provided with an inner inlet pipe diameter ID in the range of about 28 to 48 inches.

Figure 2:
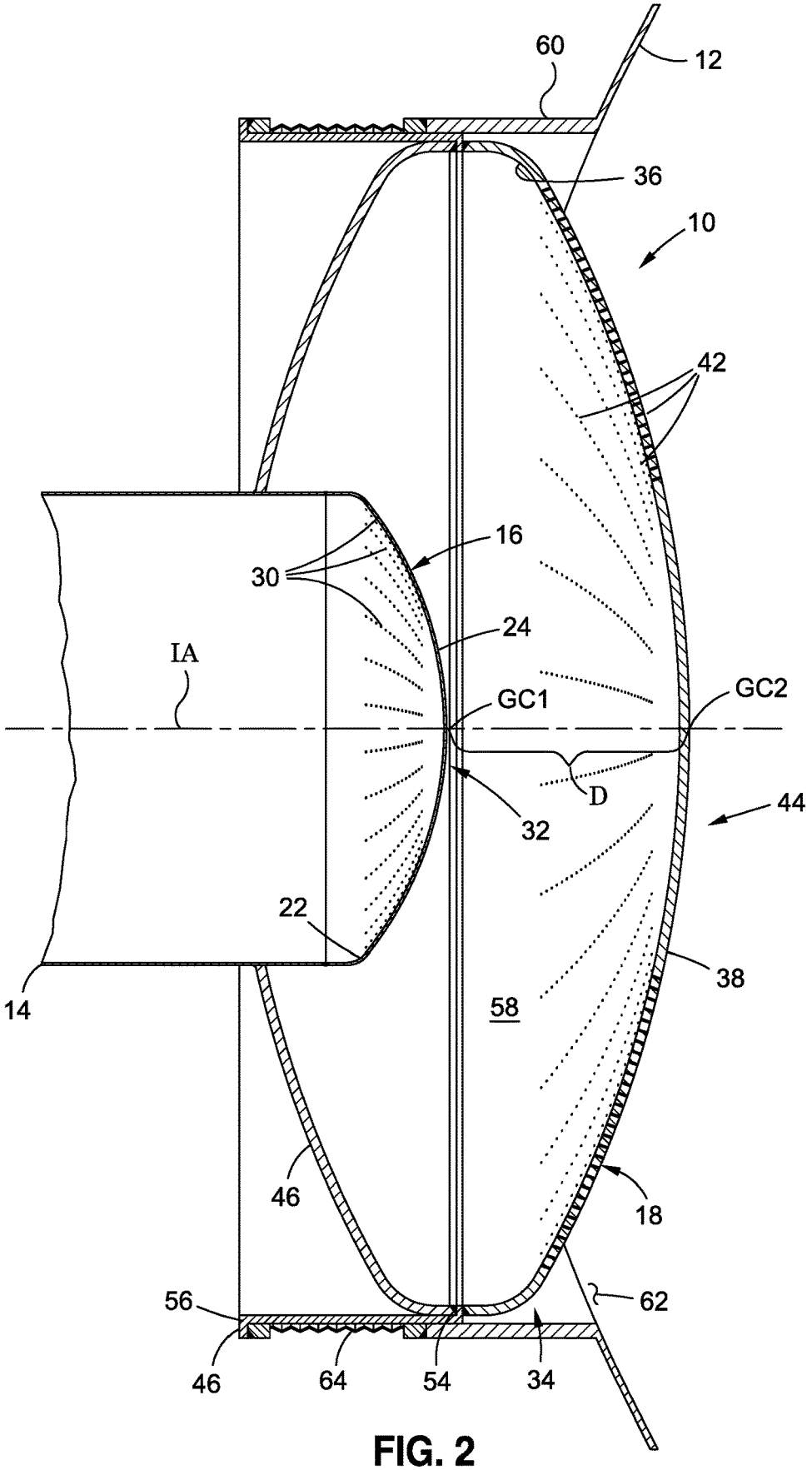
FIG. 2 is an enlargement of the encircled region 2 shown in FIG. 1.
Figure 3:
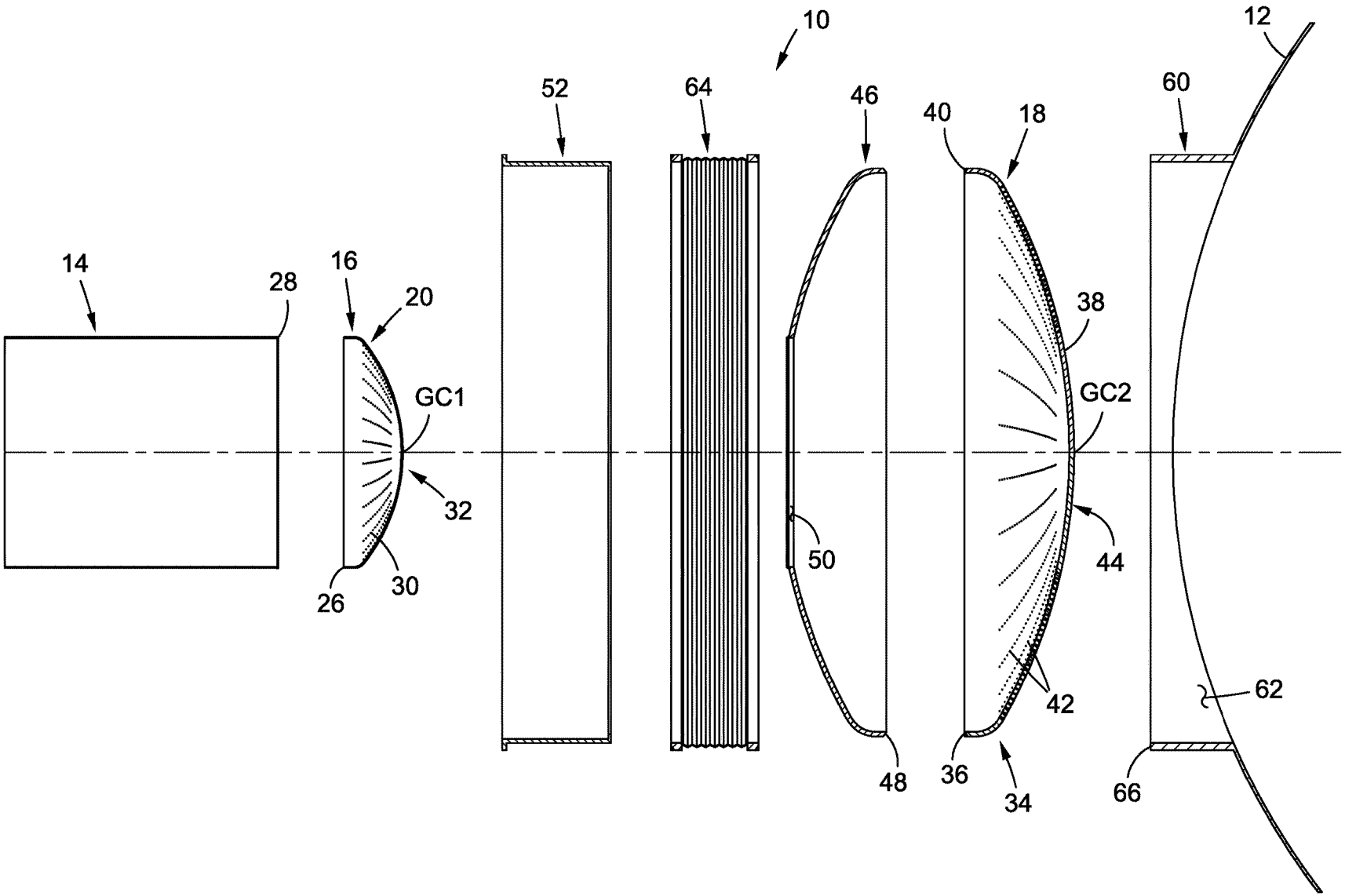
FIG. 3 is an exploded view of the multi-stage condenser dump device shown in FIGS. 1 and 2.

In the embodiment shown in FIGS. 1-3, the dump device 10 comprises a first stage 16 which is fluidly connectible to the steam inlet pipe 14, and a second stage 18 which is operatively coupled to the first stage 16 and is fluidly connectible to the duct 12. In FIGS. 1 and 2, the dump device 10 is depicted in operative attachment to both the steam inlet pipe 14 and the duct 12 as allows the dump device 10 to achieve its primary functional objective of facilitating the discharge of steam from the steam inlet pipe 14 into the duct 12 in a noise and vibration minimizing manner.

The first stage 16 comprises a first head 20 which, in the dump device 10, is torispherical, though alternative shapes/configurations which are described in more detail below in relation to other embodiments are intended to be within the spirit and scope of the present disclosure. In greater detail, the first head 20 defines a geometric center GC1, an interior surface 22, and an exterior surface 24 which is opposed to the interior surface 22 and is of a prescribed first surface area. The interior and exterior surfaces 22, 24 extend to and terminate at a common distal rim 26 also defined by the first head 20. It is contemplated that the first head 20, and in particular the rim 26 thereof, will be formed to be of a diameter which is generally equal to the inner inlet pipe diameter ID of the steam inlet pipe 14, and hence the diameter of a distal rim 28 defined by the steam inlet pipe 14. In this regard, in an exemplary manner of facilitating the attachment of the dump device 10 to the steam inlet pipe 14, the rim 26 of the first head 20 is attached to the corresponding rim 28 of the steam inlet pipe 14 through the use of a weld such that the exterior surface of the steam inlet pipe 14 is generally flush or continuous with that portion of the exterior surface 24 of the first head 20 proximate the rim 26.

Figure 4:
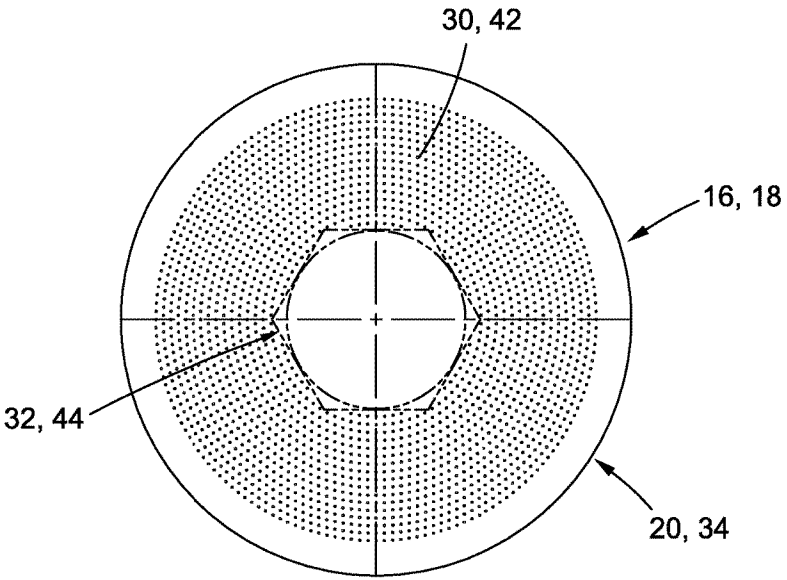
FIG. 4 is a front elevational view of the first and/or second stage of the dump device shown in FIGS. 1-3 depicting an exemplary blank area devoid of discharge holes, and an alternatively configured blank area in phantom.

The first head 20 further includes a multiplicity of first discharge holes 30 disposed therein in a prescribed arrangement. The first discharge holes 30 extend through first head 20 between the interior and exterior surfaces 22, 24 thereof so as to be placeable into fluid communication with the steam inlet pipe 14 when the first stage 16 is connected thereto in the aforementioned manner. As most easily seen in FIG. 2, in an exemplary pattern of the first discharge holes 30 in the first head 20, the first discharge holes 30 are arranged in multiple, equidistantly spaced rows which each extend generally radially between the geometric center GC1 and the rim 26. However, the opposed ends of each of these rows terminate short of respective ones of the geometric center GC1 and the rim 26. Along these lines, it is contemplated that within the first stage 16, the geometric center GC1 may reside within a blank area 32 which may be devoid of any of the first discharge holes 30, as best shown in FIG. 4. In an exemplary implementation, the blank area 32 has a generally circular shape or profile, though other symmetric geometric shapes are intended to be within the spirit and scope of the present disclosure. By way of example and not by way of limitation, the blank area 32 may be hexagonal (as shown in phantom in FIG. 4), triangular, quadrangular, etc. The functionality of the blank area 32, if included in the first head 20 of the first stage 16, will be described in more detail below.

Each of the first discharge holes 30 formed in the first head 20 has a generally circular cross-sectional configuration of a first prescribed diameter. Along these lines, with the blank area 32 being included in the first stage 16, each of the first discharge holes 30 is formed in the first head 20 so as to define an axis which is non-parallel to the inlet axis IA when the dump device 10, and in particular the first stage 16 thereof, is attached to the steam inlet pipe 14. Though each of the first discharge holes 30 is generally circular, other geometric shapes (e.g., quadrangular, triangular, oval, octagonal, etc.) are considered to be within the spirit and scope of the present disclosure, the particular shape selected for each of the first discharge holes 30 being based on a particular performance characteristic to be imparted to the dump device 10, as will also be described in more detail below.

Similar to the first stage 16, the second stage 18 comprises a second head 34 which, in the dump device 10, is also torispherical, though again alternative shapes/configurations which are described in more detail below in relation to other embodiments are intended to be within the spirit and scope of the present disclosure. The second head 34 defines a geometric center GC2, an interior surface 36, and an exterior surface 38 which is opposed to the interior surface 36 and is of a prescribed second surface area which exceeds the first surface area defined by the exterior surface 24 of the first head 20. In what are contemplated to be typical implementations of the dump device 10, the second surface area defined by the exterior surface 38 of the second head 34 will be about 110% to 500% greater than the first surface area defined by the exterior surface 24 of the first head 20, though differing ranges of variability are considered to be within the spirit and scope of the present disclosure based on the desired performance characteristics for the dump device 10. The interior and exterior surfaces 36, 38 extend to and terminate at a common distal rim 40 also defined by the second head 34.

The second head 34 further includes a multiplicity of second discharge holes 42 disposed therein in a prescribed arrangement. The second discharge holes 42 extend through second head 34 between the interior and exterior surfaces 36, 38 thereof so as to be placeable into fluid communication with steam discharged into the dump device 10 from the steam inlet pipe 14 via the first discharge holes 30, and further with the interior of the duct 12, when the dump device 10 is attached to and operatively integrated between the duct 12 and the steam inlet pipe 14. As most easily seen in FIG. 2, in an exemplary pattern of the second discharge holes 42 in the second head 34, the second discharge holes 42 are also arranged in multiple, equidistantly spaced rows which each extend generally radially between the geometric center GC2 and the rim 40. However, the opposed ends of each of these rows terminate short of respective ones of the geometric center GC2 and the rim 40. Along these lines, it is contemplated that within the second stage 18, the geometric center GC2 may itself reside within a blank area 44 which is devoid of any of the second discharge holes 42, as also shown in FIG. 4. In an exemplary implementation, the blank area 44 has a generally circular shape or profile, though, as with the blank area 32 of the first head 20, other symmetric geometric shapes are intended to be within the spirit and scope of the present disclosure, e.g., the blank area 44 may be hexagonal (as shown in phantom in FIG. 4), triangular, quadrangular, etc. The functionality of the blank area 44, if included in the second head 34 of the second stage 18 alone or in combination with the blank area 32 included in the first head 20 of the first stage 16, will also be described in more detail below.

Each of the second discharge holes 42 formed in the second head 34 has a generally circular cross-sectional configuration of a second prescribed diameter. Along these lines, with the blank area 44 being included in the second stage 18, each of the second discharge holes 44 is formed in the second head 34 so as to define an axis which is non-parallel to the steam inlet axis IA when the dump device 10 is attached to the steam inlet pipe 14. As described above for the first discharge holes 30, though each of the second discharge holes 42 is generally circular, other geometric shapes (e.g., quadrangular, triangular, oval, octagonal, etc.) are considered to be within the spirit and scope of the present disclosure, the particular shape selected for each of the second discharge holes 42 (which may be the same or dissimilar to those of the first discharge holes 30) being based on a particular performance characteristic to be imparted to the dump device 10.

In the dump device 10, the attachment or operative interface of the second stage 18 to the first stage 16 is facilitated, in part, by a cap 46 included in the dump device 10. As seen in FIGS. 1-3, the cap 46 has a torispherical shape similar in size, outer diameter dimension and overall contour to that of the second stage 18, and in particular the second head 34 thereof. Along these lines, the cap 46 defines a distal rim 48, and an enlarged central opening 50 which is most easily seen in FIG. 3. In one exemplary manner of facilitating the operative interface of the second stage 18 to the first stage 16 in the dump device 10, both the second head 34 and the cap 46 are attached to a common bracket 52. In greater detail, as best seen in FIGS. 2 and 3, the bracket 52 has an annular configuration, with a radially inwardly extending first flange 54 partially defining one distal rim thereof, and a radially outwardly extending second flange 56 partially defining the remaining, opposed distal rim thereof. The inner diameter of the bracket 52 slightly exceeds the maximum outer diameter dimensions of the second head 34 and cap 46 which, as indicated above, are substantially equal to each other. The rims 40, 48 defined by respective ones of the second head 34 and cap 46 are attached to opposed sides of the first flange 54 such that the cap 46 resides within the interior of the bracket 52, and the second head 34 protrudes from that end of the bracket 52 circumvented by the rim partially defined by the first flange 54. With both the second head 34 and cap 46 being attached to the bracket 52 in the aforementioned manner, the second head 34 and cap 46 collectively define an interior chamber 58. As is most apparent from FIG. 2, both the opening 50 and second discharge holes 42 communicate with the interior chamber 58.

In operatively interfacing the second stage 18 to the first stage 16, both the first head 20 and a portion of the steam inlet pipe 14 are advanced through the opening 50 and into the interior chamber 58 collectively defined by the second head 34 and cap 46 as attached to the bracket 52. The continuous peripheral rim of the cap 46 defining the opening 50 therein is attached to the exterior surface of the steam inlet pipe 14 by, for example, the use of a weld. Thus, the cooperative engagement of the second stage 18 to the first stage 16 is not direct, but rather is facilitated indirectly by the intervening cap 46 and a portion of the steam inlet pipe 14. As will be recognized, the diameter of the opening 50 within the cap 46 is preferably sized so as to only slightly exceed the outer diameter of the steam inlet pipe 14.

Further, in operatively interfacing the dump device 10, and in particular the second stage 18 thereof, to the duct 12, it is contemplated that the bracket 52 will be slidably advanced into and concentrically nested within a complementary annular pipe adapter 60 which is attached to and protrudes from the duct 12. As is best seen in FIG. 2, the adapter 60 circumvents an outlet opening 62 which is disposed within the duct 12 as needed to facilitate the flow of steam into the interior thereof via the steam inlet pipe 14 and intervening dump device 10. When the bracket 52 is properly interfaced to the adapter 60, the first flange 54 will normally permanently reside within the interior of the adapter 60, with the second flange 56 permanently residing to the exterior thereof. As further seen in FIGS. 1-3, it is contemplated that a selectively expandable and collapsible bellows 64 may be effectively integrated between the bracket 52 and adapter 60, the bellows 64 circumventing the exterior surface of the bracket 52 and being operatively captured between the second flange 56 and a distal rim 66 defined by the adapter 60. The use of the bellows 64, if included as part of the interface modality of the dump device 10 to the duct 12, will be described in more detail below as well.

As further seen in FIGS. 1-3, with the first stage 16 being attached to the steam inlet pipe 14 in the aforementioned manner, and the second stage 18 being cooperatively engaged to both the first stage 16 and the duct 12 in the aforementioned manner, the inlet axis IA defined by the steam inlet pipe 14 passes through approximately the geometric centers GC1, GC2 of respective ones of the first and second heads 20, 34. As a result, as seen in FIG. 2, a portion of this inlet axis IA defines a prescribed distance D which separates the geometric center GC1 of the first head 20 from the geometric center GC2 of the second head 34. This distance D is variable, and may be selected in accordance with the desired performance characteristics for the dump device 10. Further, in the operative arrangement shown in FIGS. 1-3, it is contemplated that the inlet axis IA will also perpendicularly intersect the duct axis DA, though the absence of such intersection and/or perpendicular relationship will not necessarily, in and of itself, unduly compromise the operational efficacy of the dump device 10.

Further, with the dump device 10 being cooperatively engaged to the steam inlet pipe 14 and duct 12 in the aforementioned manner, the flow of steam through the steam inlet pipe 14 along the inlet axis IA toward the first stage 16 results in the eventual discharge of the steam through the first discharge holes 30 and into the interior chamber 58 collectively defined by the second stage 18 and cap 46. From the interior chamber 58, steam flows through and is discharged from the second discharge holes 42 of the second stage 18 into the interior of the duct 12. The operative arrangement shown in FIGS. 1-3 also results in the blank area 32 of the first head 20 being generally aligned with the blank area 44 of the second head 34 along the inlet axis IA. The alignment of these blank areas 34, 44 effectively prevents the discharge of steam from the steam inlet pipe 14 into the interior of the duct 12 directly along or in a direction parallel to the inlet axis IA. Along these lines, including the blank areas 34, 44 in respective ones of the first and second stages 16, 18, and in particular the first and second heads 20, 34 thereof, helps to, among other things, reduce reaction forces, give direction to jet flow through the first and second discharge holes 30, 42, and diverge the jet flow through the first and second discharge holes 30, 42. Thus, stated another way and as indicated above, the blank areas 34, 44 can be used to prevent direct line of sight flow from the first stage 18 to and through the second stage 18 for the purposes of preventing jet recombination and lowering reaction forces.

As indicated above, though the blank areas 34, 44 are shown in FIGS. 1-4 as being circular, they can each be provided in any symmetric geometric shape for purposes of either achieving prescribed performance attributes in the dump device 10, and/or imparting a prescribed level of structural strength to the first head 20 and/or second head 34. With particular regard to the positioning or placement of the blank areas 34, 44 within respective ones of the first and second heads 20, 34, it is also contemplated that such placements need not necessarily be one which encompasses respective ones of the geometric centers GC1, GC2. Along these lines, blank areas 34, 44 of any shape or size may be included in prescribed locations of respective ones of the first head 20 and/or the second head 34 for purposes of avoiding the erosion and/or vibration of any portion of the dump device 10, duct 12, or some type of obstacle/obstruction present within the duct 12. Though both the first and second heads 20, 34 will each typically be provided with the respective blank areas 34, 44 of similar shape and location in most implementations of the dump device 10, the possibilities exist that: 1) only one of the first and second heads 20, 34 may be provided with its corresponding blank area 34, 44 (which may be of any shape or provided at any location), or 2) even if both of the first and second heads 20, 34 are provided with their respective blank areas 34, 44, such blank areas 34, 44 may be provided in dissimilar shapes and/or in locations which are not necessarily aligned with each other as described above for the blank areas 34, 44 in the context of the embodiment of the dump device shown in FIGS. 1-3.

In each of the first and second stages 16, 18, the first and second discharge holes 30, 42 are preferably drilled perpendicular to the curved surfaces of the corresponding first and second heads 20, 34, which diffuses the jets, improves distribution of energy into the duct 12, and minimizes noise, vibration, and reaction loads. As also indicated above, though being provided with a circular shape in the embodiment of the dump device 10 shown in FIGS. 1-3, the first and second discharge holes 30, 42 may each be provided in any one of a multiplicity of different geometric shapes depending on the desired performance characteristics of the dump device 10. Along these lines, though both the first and second heads 20, 34 will each typically be provided with the respective first and second discharge holes 30, 42 of the same shape and in similar patterns in most implementations of the dump device 10, the possibility exists that the first and second discharge holes 30, 42 may be provided in dissimilar shapes and/or patterns within respective ones of the first and second heads 20, 34. In any implementation, the objective is to choose the shape(s) and/or pattern(s) of the first and second discharge holes 30, 42 as minimizes the noise generated by the jet recombination effect.

As to the distance D which separates the geometric center GC1 of the first head 20 from the geometric center GC2 of the second head 34, as previously explained this distance D is variable, and may be selected in accordance with the desired performance characteristics for the dump device 10. In greater detail, as indicated above, since pressure distribution between the first and second stages 16, 18 has an important impact on performance, the dump device 10 may be configured to have a Mach number less than 1 (e.g., about 0.5) at the first stage 16 to reduce or eliminate noise or shock wave problems where the steam is inside the dump device 10 (i.e., within the interior chamber 58), with the outer or second stage 18 having a Mach more than 1 for space limitation. The selection of the distance D (alone or in combination with the blank area and/or discharge hole shape, pattern and/or location options discussed above) can be used to further these objectives, and to further achieve the result of the second stage 18 limiting average velocity across the surface of the dump device 10 to an acceptable limit during normal and trip conditions, such limits typically being about subsonic during normal operating conditions and about transonic during trip. The velocity limit during normal operation is selected to reduce noise, with the velocity limit during trip being selected to prevent excessive reaction loads.

The functionality of the dump device 10 may also be influenced by the protrusion or penetration distance of the second head 34 of the second stage 18 into the interior of the duct 12. Any significant blockage of the duct 12 by the dump device 10 is undesirable, as it could increase condenser pressure and consequently decreases plant efficiency by creating backpressure on the duct 12. In an exemplary implementation, the maximum distance of second stage 18 projection into the duct 12 will typically be limited to about 1%-5% of the cross-sectional area of the duct 12.

The use of the bracket 52 and adapter 60 (with or without the bellows 64) to facilitate the mounting of the dump device 10 to the duct 12 is intended to provide an expansion joint which absorbs reaction loads from steam discharge, and does not translate bending loads directly into the duct 12. However, the use of this particular mounting arrangement as shown in FIGS. 1-3 and described above is intended to be optional only, and may be substituted with other, alternative connection modalities without departing from the sprit and scope of the present disclosure.

As is apparent from the foregoing description of the various structural features of the dump device 10, their attendant functionality, and the available structural variation options corresponding to these features, the performance characteristics of the dump device 10 may be selectively manipulated or "tuned" for a prescribed application by varying any of the following features in any combination: 1) the size of the first surface area defined by the exterior surface 24 of the first head 20 in comparison to the size of the second surface area defined by the exterior surface 38 of the second head 34; 2) the size, shape and/or location of the blank area 32 (if any) in the first head 20; 3) the size, shape and/or location of the blank area 44 (if any) in the second head 34; 4) the size, shape and/or pattern of the first discharge holes 30 in the first head 20; 5) the size, shape and/or pattern of the second discharge holes 42 in the second head 34; 6) the distance D separating the geometric centers GC1 and GC2 of the first and second heads 20, 34 from each other; and 7) the protrusion distance of the second head 34 of the second stage 18 into the interior of the duct 12. Several more notable potential structural variations implemented in accordance with these selectively modifiable structural features will now be described below in relation to other embodiments of the dump device.

Figure 5A:
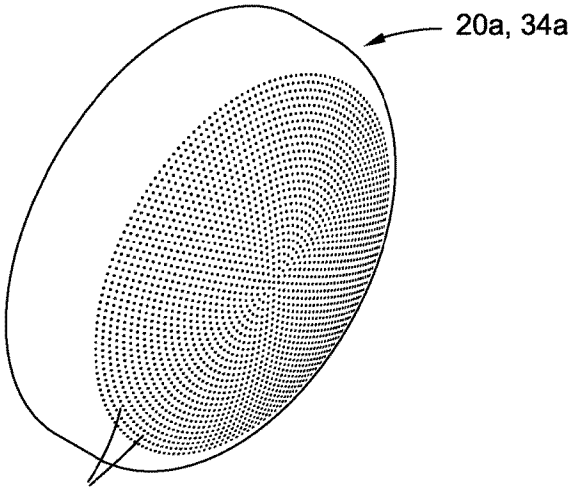
FIG. 5A is a front perspective view of alternative version of the first and/or second stage of the dump device shown in FIGS. 1-4 wherein the blank area is eliminated in favor of an even distribution of discharge holes.
Figure 5C:
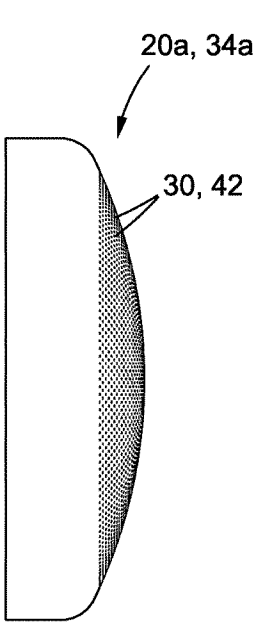
FIG. 5C is a side elevational view of alternative version of the first and/or second stage shown in FIGS. 5A and 5B.
Figure 5B:
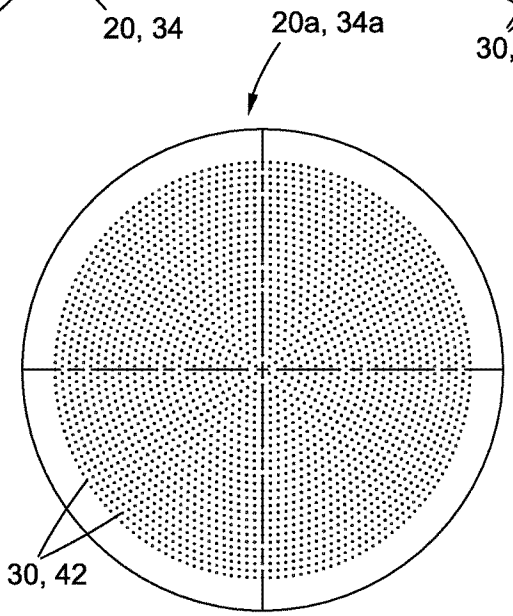
FIG. 5B is a front elevational view of alternative version of the first and/or second stage shown in FIG. 5A.

As indicated above, the performance characteristics of the dump device 10 may be selectively tuned for a prescribed application by, among other things, possibly eliminating the blank area(s) 32, 44 in respective ones of the first and/or second heads 20, 34, and/or modifying the size, shape and/or pattern of the first and second discharge holes 30, 42 in respective ones of the first and/or second heads 20, 34. In this regard, a first presently contemplated variation of the first and second heads 20, 34 of the first and second stages 16, 18 as shown in FIGS. 1-4 and described above is provided by the alternative first and second heads 20*a*, 34*a* shown as perspective, front and side elevational views in respective ones of FIGS. 5A, 5B and 5C. In these alternative first and second heads 20*a*, 34*a*, the aforementioned blank areas are eliminated, with the corresponding first and second discharge holes 30, 42 being provided in a generally even distribution which extends over the geometric centers GC1, GC2. In an exemplary implementation, this even distribution in the first and second heads 20*a*, 34*a* is achieved by arranging the corresponding first and second discharge holes 30, 42 in a pattern of generally concentric rings as is most easily seen in FIG. 5B, with one of the first and second discharge holes 30, 42 possibly being located at a respective one of the geometric centers GC1 and GC2, and thus being positioned on and coaxially aligned with the inlet axis IA.

Even with the full range of structural variation options available for the dump device 10 as described above, in the version shown in FIGS. 1-4, the first and second heads 20, 34 share common structural attributes, i.e., both are provided with the respective similarly shaped/proportioned blank areas 32, 44 and with the respective first and second discharge holes 30, 42 of similar size and pattern/distribution. In an exemplary alternative implementation of the dump device 10, the first and second heads 20, 34 may be substituted with corresponding ones of the first and second heads 20*a*, 34*a*. In this particular variant of the dump device 10, the first and second heads 20*a*, 34*a* are each devoid of any of the aforementioned blank areas 32, 44, with their respective first and second discharge holes 30, 42 also being of similar size and pattern/distribution. However, bearing in mind the available range of potential structural variations for the dump device 10, those of ordinary skill in the art will recognize that further alternative implementations are possible wherein one, rather than both, of the first and second heads 20, 34 is substituted with a corresponding one, rather than both, of the first and second heads 20*a*, 34*a*.

Figure 6:
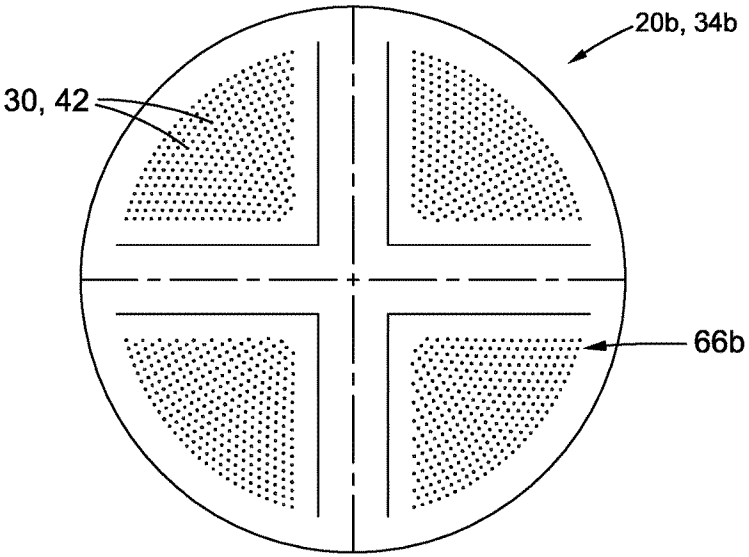
FIG. 6 is a front perspective view of yet another alternative version of the first and/or second stage of the dump device shown in FIGS. 1-5C wherein prescribed blank areas are interposed between discharge holes arranged in prescribed patterns.

An even further range of available, presently contemplated variations to the first heads 20, 20*a* and second heads 34, 34*a* described above is shown in FIGS. 6, 7 and 8. In greater detail, FIG. 6 depicts alternative first and second heads 20*b*, 34*b* wherein the corresponding first and second discharge holes 30, 42, rather than being provided in radially extending rows or in an evenly distributed pattern of concentric rings, are segregated into separate sets 66*b* which are each of a prescribed shape, the sets 66*b* further being arranged in a prescribed pattern. In FIG. 6, each of the sets 66*b* has a generally triangular shape, with the sets 66*b* being arranged in respective ones of the four equidistantly spaced quadrants as defined by the circular profiles of the first and second heads 20*b*, 34*b*. As a result, in the first and second heads 20*b*, 34*b*, blank spaces are provided in more of a prescribed pattern, as they are defined between each of the sets 66*b*.

Figure 7:
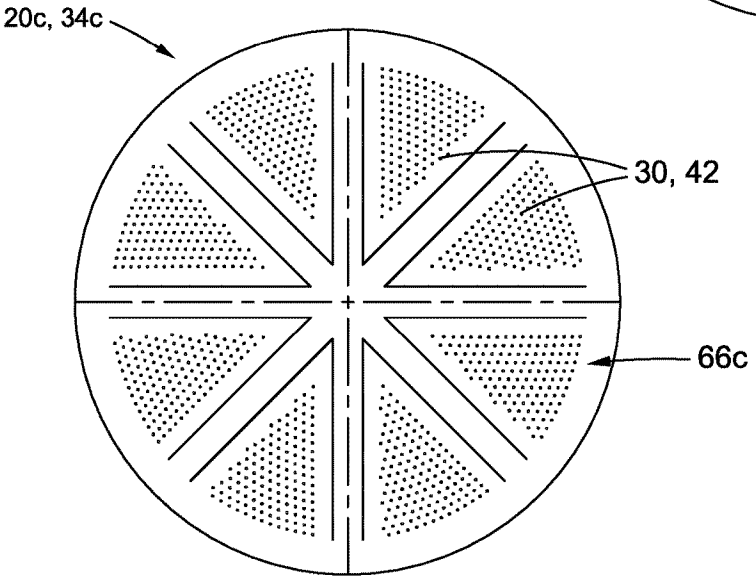
FIG. 7 is a front perspective view of yet another alternative version of the first and/or second stage of the dump device shown in FIGS. 1-6 wherein prescribed blank areas are interposed between discharge holes arranged in prescribed patterns.

Similarly, FIG. 7 depicts further alternative first and second heads 20*c*, 34*c* wherein the corresponding first and second discharge holes 30, 42 are segregated into separate sets 66*c* which are also each of a prescribed shape and arranged in a prescribed pattern. In this particular variation, each of the sets 66*c* has a generally wedge or pie shaped profile, the sets 66*c* being arranged in roughly equidistantly spaced internals of about 45 degrees such that two sets 66*c* are located in respective ones of the four equidistantly spaced quadrants as defined by the circular profiles of the first and second heads 20*c*, 34*c*. As a result, in the first and second heads 20*c*, 34*c*, blank spaces are also provided in more of a prescribed pattern, as they are defined between each of the sets 66*c*.

Figure 8:
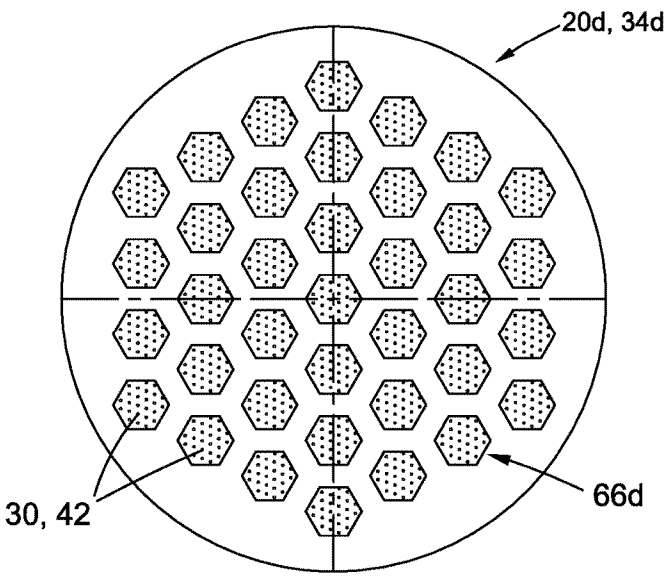
FIG. 8 is a front perspective view of yet another alternative version of the first and/or second stage of the dump device shown in FIGS. 1-7 wherein prescribed blank areas are interposed between discharge holes arranged in prescribed patterns.

FIG. 8 depicts yet further alternative first and second heads 20*d*, 34*d* wherein the corresponding first and second discharge holes 30, 42 are segregated into separate sets 66*d* which are also each of a prescribed shape and arranged in a prescribed pattern. In this particular variation, each of the sets 66*d* has a generally hexagonal shape, the sets 66*d* being arranged in roughly equidistantly spaced relation to each other. As a result, in the first and second heads 20*d*, 34*d*, blank spaces are also provided in more of a prescribed pattern, as they are defined between each of the sets 66*d*.

Thus, FIGS. 6-8 exemplify what is explained above, i.e., though the blank areas 34, 44 of the first and second heads 20, 34 are shown in FIGS. 1-4 as being circular, they can each be provided in any symmetric geometric shape for purposes of either achieving prescribed performance attributes in the dump device 10, and/or imparting a prescribed level of structural strength to the first head 20*b*, 20*c*, 20*d* and/or second head 34*b*, 34*c*, 34*d*. Along these lines, the arrangement of the sets 66*b*, 66*c*, 66*d* and the patterns/shapes of the resultant blank areas may function to avoid the erosion and/or vibration of any portion of the dump device 10, duct 12, or some type of obstacle/obstruction present within the duct 12. As an extension to the aforementioned variations corresponding to the potential substitution of one or both of the first and second heads 20, 34 with one or both of the first and second heads 20*a*, 34*a*, in accordance with additional exemplary alternative implementations of the dump device 10, the first and/or second heads 20, 34 may be substituted with corresponding ones of the first heads 20*a*, 20*b*, 20*c*, 20*d* and/or second heads 34*a*, 34*b*, 34*c*, 34*d* in any combination, though it will typically be the case that the first and second stages 16, 18 are provided with their respective first and second discharge holes 30, 42 being of similar size and pattern/distribution (thus having blank areas, if any, of similar size and shape as well).

Figure 9:
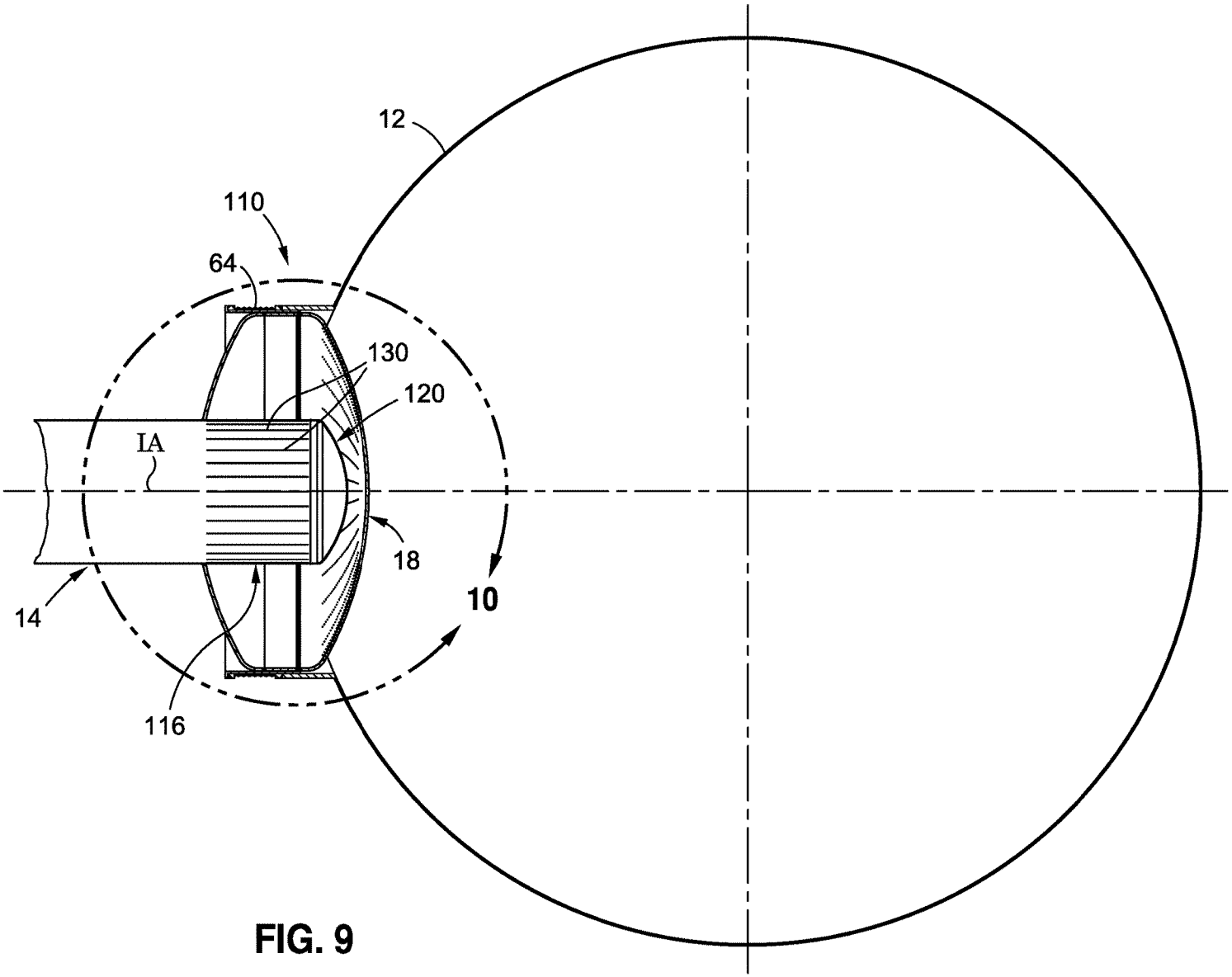
FIG. 9 is a partial cross-sectional view of a multi-stage condenser dump device constructed in accordance with a second embodiment of the present disclosure as operatively coupled to a condenser duct.
Figure 10:
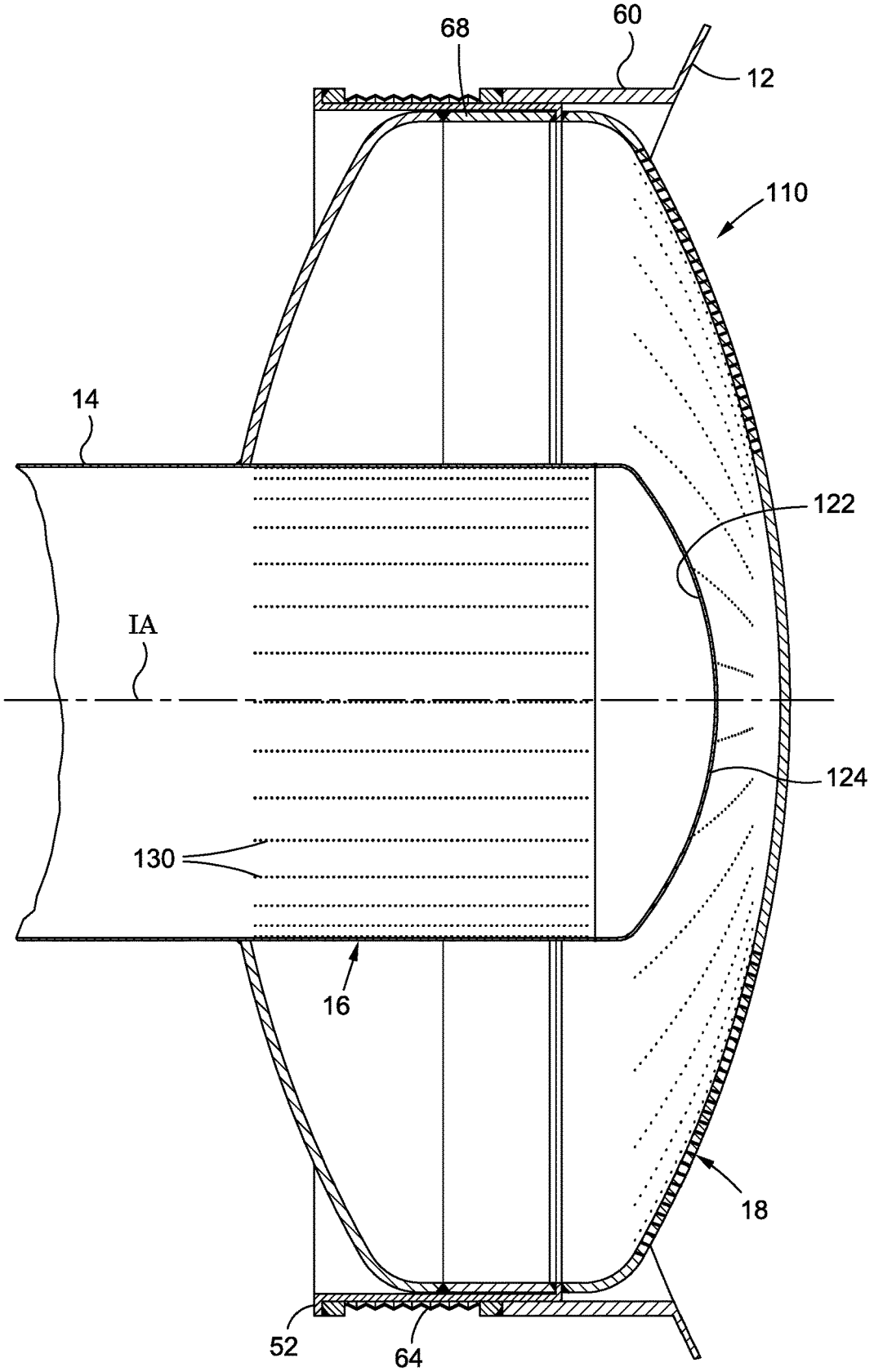
FIG. 10 is an enlargement of the encircled region 10 shown in FIG. 9.
Figure 11:
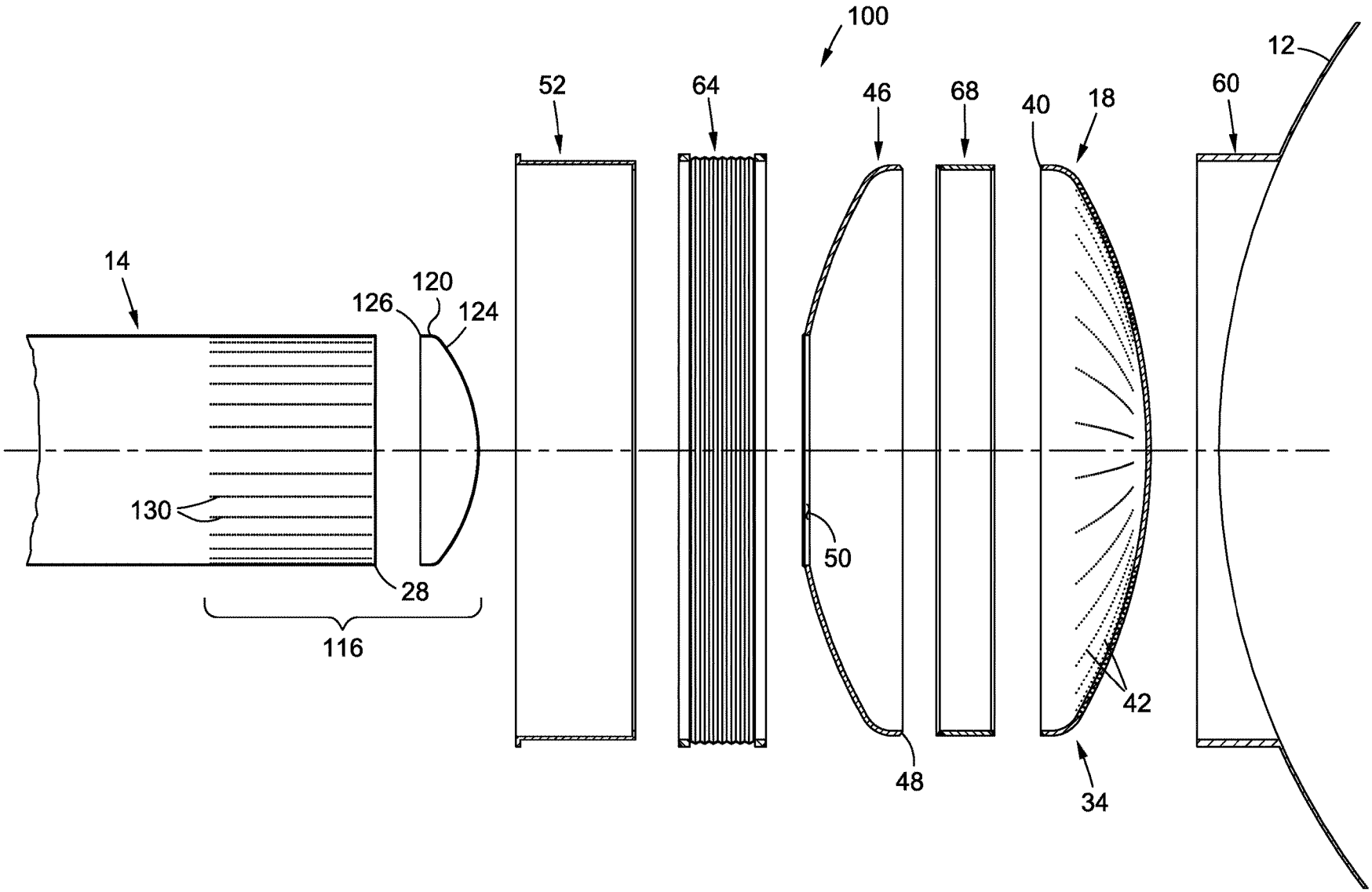
FIG. 11 is an exploded view of the multi-stage condenser dump device shown in FIGS. 9 and 10.

Referring now to FIGS. 9, 10 and 11, there is shown a dump device 110 constructed in accordance with a second embodiment of the present disclosure. Many of the structural and functional features of the dump device 110 are the same as those described above in relation to the dump device 10. Thus, only the structural distinctions between the dump devices 10, 110, and the distinctions between the ancillary structures used to facilitate the cooperative engagement thereof to the duct 12, will be described in more detail below with specific reference to FIGS. 9-11.

In greater detail, one of the primary distinctions between the dump devices 10, 110 lies in the first stage 116 of the dump device 110 comprising a portion of the steam inlet pipe 14 in combination with the first head 120 which is attached to the distal end of the steam inlet pipe 14 defined by the distal rim 28 thereof. In the dump device 110, the first head 120 of the first stage 116 is, like the above-described first stage 20 of the dump device 110, torispherical, although alternative shape/configurations are also intended to be within the spirit and scope of the present disclosure. However, in contrast to the first head 20 of the dump device 10, which is outfitted with the aforementioned first discharge holes 30 in any one of a multiplicity of different potential patterns and arrangements (with or without corresponding blank areas such as the blank area 32), the first head 120 is devoid of any such discharge holes. Rather, the first head 120 is essentially a solid structure attachable to the steam inlet pipe 14. In the first head 120, the opposed, continuous interior and exterior surfaces 122, 124 defined thereby extend to and terminate at the common distal rim 126 which is formed to be of a diameter generally equal to the inner inlet pipe diameter ID of the steam inlet pipe 14, and hence the diameter of the distal rim 28 defined by the steam inlet pipe 14. Thus, as with the attachment of the first head 20 the steam inlet pipe 14, an exemplary matter of facilitating the attachment of the first head 120, and in particular the rim 126 thereof, to the corresponding rim 28 of the steam inlet pipe 14 is through the use of a weld such that the exterior surface of the steam inlet pipe 14 is generally flush or continuous with that portion of the exterior surface 124 of the first head 120 proximate the rim 126.

Because the first head 120 is devoid of any discharge holes such as the aforementioned first discharge holes 30, first discharge holes 130 are instead provided within the distal portion of the steam inlet pipe 14 extending to the distal rim 28 defined thereby. The first discharge holes 130 extend through the steam inlet pipe 14 between the interior and exterior surfaces thereof in a direction which is preferably generally perpendicular to the inlet axis IA. As seen in FIGS. 9-11, in an exemplary pattern of the first discharge holes 130 in the first stage 116, the first discharge holes 130 are arranged in multiple, equidistantly spaced rows which extend circumferentially about the steam inlet pipe 14, each in generally parallel relation to the inlet axis IA. Each of the first discharge hole 130 formed in the steam inlet pipe 14 preferably has a generally circular cross-sectional configuration of a first prescribed diameter. However, although each of the first discharge holes 130 is generally circular, other geometric shapes (e.g., quadrangular, triangular, oval, octagonal, etc.) are also considered to be within the spirit and scope of the present disclosure, the particular shape selected for each of the first discharge holes 130 being based on particular performance characteristics to be imparted to the dump device 110. Along these lines, the axial length of each row of the first discharge holes 130 may also be selectively increased or decreased in comparison to that shown in FIGS. 9-11 for purposes of adjusting or tuning the performance characteristics to be imparted to the dump device 110.

As is most easily seen in FIG. 10, in the dump device 110, the attachment or operative interface of the first stage 116 to the second stage 18 is facilitated by advancing the first head 120 and at least that portion of the steam inlet pipe 14 having the first discharge holes 130 formed therein through the opening 50 of the cap 46. However, in the arrangement used to facilitate the cooperative engagement of the dump device 110 to both the steam inlet pipe 14 and duct 12 as shown in FIGS. 9 and 10, the distal rim 48 defined by the cap 46 is not attached (e.g., welded) directly to the first flange 54 of the bracket 52. Rather, in the arrangement shown in FIGS. 9-11, the rim 48 of the cap 46 is attached (e.g., welded) to one of the opposed, complementary rims defined by an annular pipe segment 68, with the remaining rim defined by the pipe segment 68 being attached (e.g., welded) to the first flange 54. Thus, in the arrangement shown in FIGS. 9-11, the interior chamber 58 is collectively defined by the cap 46, second head 34, and intervening pipe segment 68, as opposed to the cap 46 and second head 34 standing alone. In this particular arrangement, the continuous peripheral rim of the cap 46 defining the opening 50 therein is still attached to the exterior surface of the steam inlet pipe 14 by, for example, the use of a weld. By virtue of the inclusion of the pipe segment 68 between the cap 46 and second head 34, the interior chamber 58 in the arrangement shown in FIGS. 9-11 is of greater width in comparison to that shown in relation to FIGS. 1-3, as is needed to accommodate the greater portion of that length of the steam inlet pipe 14 which is advanced into the interior chamber 58 as necessary to facilitate the positioning of all of the first discharge holes 130 within the interior chamber 58.

Thus, with the dump device 110 being cooperatively engaged to the steam inlet pipe 14 (as including the first discharge holes 130) and the duct 12 in the manner shown in FIGS. 9 and 10 and as fundamentally described above in relation to the cooperative engagement of the dump device 10 to the steam inlet pipe 14 and duct 12, the flow of steam through the steam inlet pipe 14 along the inlet axis IA toward the first stage 18 results in the eventual discharge of the steam through the first discharge holes 130 of the steam inlet pipe 14 and into the interior chamber 58 collectively defined by the cap 46, second head 34 and pipe segment 68. From the interior chamber 58, steam flows through and is discharged from the second discharge holes 42 of the second stage 18 into the interior of the duct 12. With the first head 120 of the first stage 116 in the dump device 110 preferably being devoid of any first discharge holes, it is contemplated that the second stage 18 included in the dump device 110 will include the same second head 34 described above in relation to the dump device 10, i.e., one provided with the blank area 44. However, those of ordinary skill in the art will recognize that the second head 34 integrated into the dump device 110 may be provided in any one of the multiplicity of variations described above, including but not limited to the second heads 34*a*, 34*b*, 34*c*, 34*d*, without departing from the spirit and scope of the present disclosure.

Figure 13:
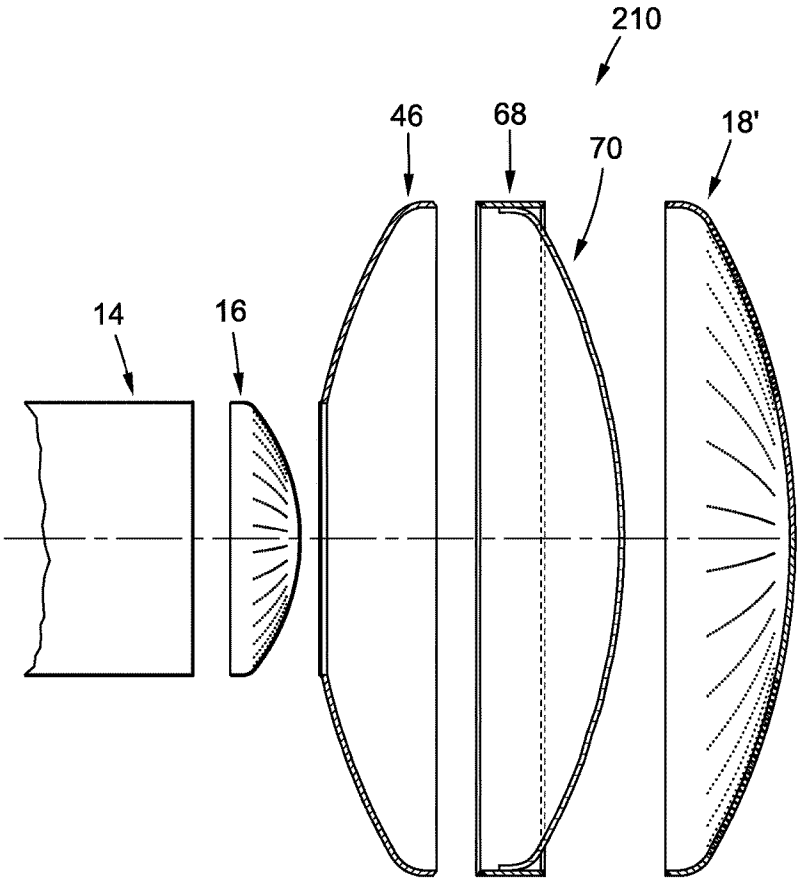
FIG. 13 is an exploded view of the multi-stage condenser dump device shown in FIG. 12.
Figure 12:
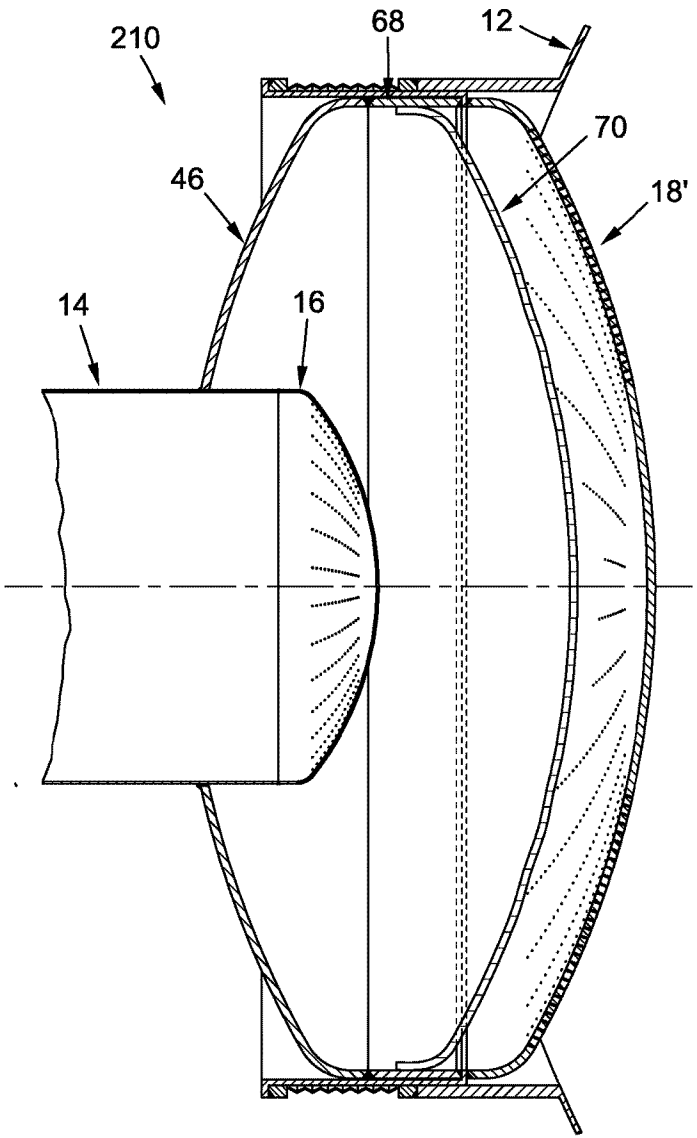
FIG. 12 is a partial cross-sectional view of a multi-stage condenser dump device constructed in accordance with a third embodiment of the present disclosure as operatively coupled to a condenser duct.

Referring now to FIGS. 12 and 13, there is provided generally schematic depictions of a dump device 210 constructed in accordance with a third embodiment of the present disclosure. Whereas the dump devices 10, 110 are each generally two-stage versions, the dump device 210 is a three-stage version essentially comprising a meld of various structural features of the dump devices 10, 110, and the arrangements shown in FIGS. 1-3 and 9-11, as elaborated upon in more detail below.

In general terms, the dump device 210, from a starting structural standpoint, largely mimics the structural and functional features of the dump device 10 and those structural features used to facilitate its cooperative engagement to both the steam inlet pipe 14 and duct 12. However, for purposes of the description below, what is described as the second stage 18 above in the dump device 10 is characterized as the third stage 18' in the dump device 210, though the second stage 18 and third stage 18' are, in large measure, structurally the same. One notable distinction between the arrangement shown in FIGS. 12-13 and that shown in FIGS. 1-3 lies in the inclusion of the pipe segment 68 between the cap 46 and first flange 54 of the bracket 52 in the arrangement shown in FIGS. 12-13, the integration of the pipe segment 68 being accomplished in the same manner described above for the arrangement shown in FIGS. 9-11 regarding the dump device 110. Stated another way, the modification of the arrangement shown in FIGS. 1-3 to include an interior chamber 58 of comparatively greater width through the inclusion of the pipe segment 68 from the arrangement shown in FIGS. 9-11 is implemented in the three-stage arrangement shown in FIGS. 12-13.

With the foregoing in mind, in the three-stage arrangement shown in FIGS. 12-13, a second stage 70, integrated between the first stage 16 and third stage 18', is essentially provided in the increased width interior chamber 58, the increased width of the interior chamber 58 effectuated by the inclusion of the pipe segment 68 being needed to accommodate the second stage 70. In greater detail, the second stage 70, in one exemplary implementation, may comprise a generally dome-shaped segment of perforated screen or mesh, or a dome-shaped plate provided with discharge holes. In either variant, it is contemplated that the peripheral rim of the second stage 70 will be secured, possibly through the use of a welded connection, to the interior surface of the pipe segment 68.

Those of ordinary skill in the art will recognize that the myriad of potential design variation options discussed above in relation to the two-stage versions of the dump device 10, 110 are also applicable to the three-stage version of the dump device 210. Along these lines, by way of example and based on the term "discharge surface" being used to encompass those surface portions of the first, second and third stages which include discharge holes or perforations, alone or in combination with one or more blank areas, the performance characteristics of the dump device 210 may be selectively manipulated or "tuned" for a prescribed application by varying any of the following features in any combination: 1) the size of the surface area defined by the discharge surface of the first stage 16 in comparison to the size of the surface area defined by the discharge surface of the second stage 70 and/or the third stage 18'; 2) the size of the surface area defined by the discharge surface of the second stage 70 in comparison to the size of the surface area defined by the discharge surface of the third stage 18' (which surface areas may be substantially equal to each other as seen in FIG. 13); 3) the size, shape and/or location of any blank area(s) (if included) in the discharge surface of the first, second and/or third stages 16, 70, 18'; 4) the size, shape and/or pattern of the discharge holes in the discharge surface of the first, second and/or third stages 16, 70, 18'; 5) the distance separating the geometric center of the first stage 16 from the that of the second stage 70 and/or the third stage 18'; 6) the distance separating the geometric center of the second stage 70 from that of the third stage 18'; and 7) the protrusion distance of the third stage 18' into the interior of the duct 12.

Figure 14:
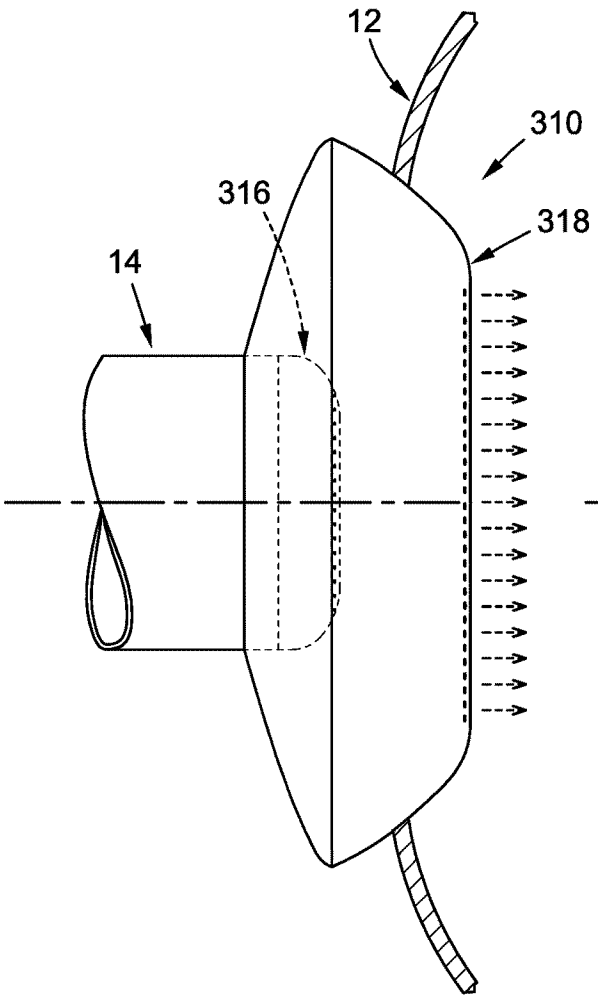
FIG. 14 is a partial cross-sectional view of a multi-stage condenser dump device constructed in accordance with a fourth embodiment of the present disclosure.

Referring now to FIG. 14, there is provided a generally schematic depiction of a dump device 310 constructed in accordance with a fourth embodiment of the present disclosure. The showing in FIG. 14 is intended to provide visual context to a further potential variant of the two-stage dump device 10 described above. In the variation shown in FIG. 14, the torispherical first and second heads 20, 34 of the first and second stages 16, 18 are substituted with generally flat versions wherein the first and second discharge holes 30, 42 and bank areas(s) 32, 44 (if any) are provided in or upon a generally flat surface, rather than a torispherical surface. One advantage provided by the flat surface architecture is potentially greater ease in drilling the first and second discharge holes 30, 42 in any pattern or arrangement. All other structural variation options as described above in relation to the dump devices 10, 110 are equally applicable to this flat surface variant serving as the dump device 310.

Figure 15:
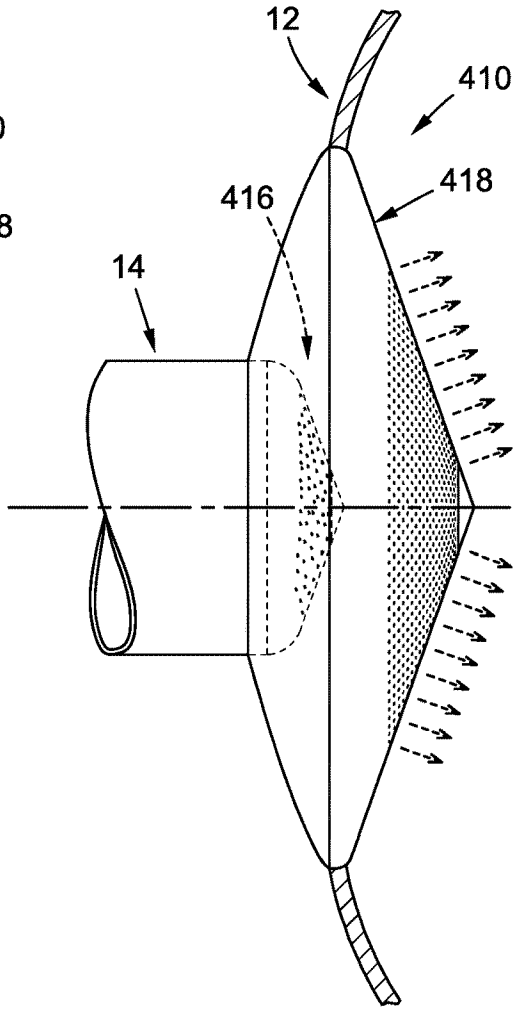
FIG. 15 is a partial cross-sectional view of a multi-stage condenser dump device constructed in accordance with a fifth embodiment of the present disclosure.

Referring now to FIG. 15, there is provided a generally schematic depiction of a dump device 410 constructed in accordance with a fifth embodiment of the present disclosure. The showing in FIG. 15 is also intended to provide visual context to a further potential variant of the two-stage dump device 10 described above. In the variation shown in FIG. 15, the torispherical first and second heads 20, 34 of the first and second stages 16, 18 are substituted with generally toriconical versions wherein the first and second discharge holes 30, 42 and bank areas(s) 32, 44 (if any) are provided in or upon corresponding generally flat surfaces arranged at prescribed angles relative to each other, rather than a torispherical surface. Advantage provided by the toriconical surface architecture potentially include greater ease in drilling the first and second discharge holes 30, 42 in any pattern or arrangement, and a dispersal of flow jets to reduce scattering, reaction forces, and noise generated by jet recombination. Again, all other structural variation options as described above in relation to the dump devices 10, 110 are equally applicable to this toriconical surface variant serving as the dump device 410.

Figure 16:
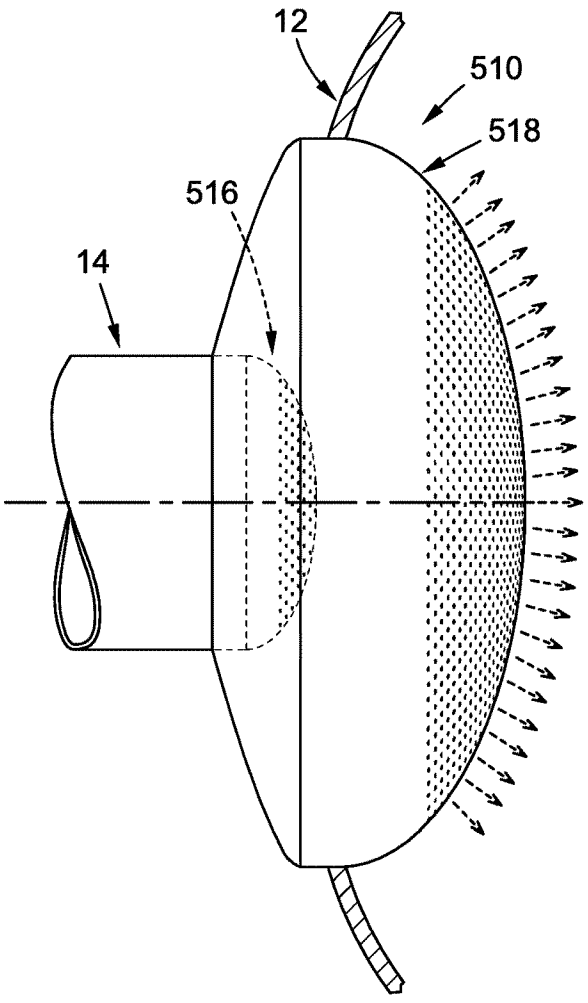
FIG. 16 is a partial cross-sectional view of a multi-stage condenser dump device constructed in accordance with a sixth embodiment of the present disclosure.

Referring now to FIG. 16, there is provided a generally schematic depiction of a dump device 510 constructed in accordance with a sixth embodiment of the present disclosure. The showing in FIG. 16 is also intended to provide visual context to a further potential variant of the two-stage dump device 10 described above. In the variation shown in FIG. 16, the torispherical first and second heads 20, 34 of the first and second stages 16, 18 are substituted with generally elliptical versions wherein the first and second discharge holes 30, 42 and bank areas(s) 32, 44 (if any) are provided in or upon corresponding generally elliptical surfaces, rather than a torispherical surface. Advantage provided by the elliptical surface architecture potentially include scattered flow jets and more surface area for increased discharge hole distribution. Again, all other structural variation options as described above in relation to the dump devices 10, 110 are equally applicable to this elliptical surface variant serving as the dump device 510.

Though not shown, further variations of the two-stage dump device 10 are contemplated wherein the torispherical first and second heads 20, 34 of the first and second stages 16, 18 are substituted with generally spherical or hemispherical versions wherein the first and second discharge holes 30, 42 and bank areas(s) 32, 44 (if any) are provided in or upon corresponding generally spherical or hemispherical surfaces, rather than a torispherical surface. Still further variations may comprise prescribed combinations of spherical, toriconical, elliptical and flat sections, i.e., a composite head with a plurality of geometric centers. Moreover, in the context of the two-stage dump device 110, any of these aforementioned surface variants could be applied to only the second head 34 of the second stage 18. Moreover, even in the context of the two-stage dump device 10, the first and second heads 20, 34 of the first and second stages 16, 18 could be provided in respective ones of any of the differing surface shapes/contours described above. These variations could also be used for any or all of the first, second and third stages 16, 70, 18' of the dump device 210 in any combination.

This disclosure provides exemplary embodiments of the present disclosure. The scope of the present disclosure is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A low profile dump device for mounting to a duct and facilitating a discharge of steam from a steam inlet into the duct at prescribed velocities during normal operating and trip conditions of a turbine, the dump device comprising:

- a first stage fluidly connectible to the steam inlet, and comprising:
  - a first head having a geometric center, an interior surface and an opposed exterior surface which is of a first surface area; and
  - a multiplicity of first discharge holes disposed in the first head in a prescribed arrangement and extending therethrough between the interior and exterior surfaces thereof along respective flow axes so as to be placeable into fluid communication with the steam inlet when the first stage is connected thereto;
- a second stage attached to the first stage and fluidly connectible to the duct, the second stage comprising:
  - a second head having a geometric center, an interior surface and an opposed exterior surface which is of a second surface area exceeding the first surface area by a prescribed percentage; and a multiplicity of second discharge holes disposed in the second head in a prescribed arrangement and extending therethrough between the interior and exterior surfaces thereof along respective flow axes so as to be in fluid communication with the first discharge holes of the first head, and placeable into fluid communication with the duct when the second stage is connected thereto;

the first and second stages being attached to each other such that the geometric centers of the first and second heads are separated from each other by a prescribed distance, and further such that when the first stage is fluidly connected to the steam inlet and the second stage is fluidly connected to the duct, an inlet axis defined by the steam inlet will extend through the geometric centers of the first and second heads and in generally perpendicular relation to a duct axis defined by the duct;

the prescribed percentage differential between the first and second surface areas and the prescribe distance between the geometric centers of the first and second heads being selected such that a steam velocity across the dump device will be subsonic during a normal operating condition of the turbine to reduce noise, and transonic during a trip condition of the turbine to prevent excessive reaction loads.

2. The dump device of claim 1 wherein each of the first and second heads is torispherical.

3. The dump device of claim 1 wherein a majority of the flow axes defined by the first and second discharge holes diverge from and extend in non-parallel relation to the steam inlet axis when the dump device is attached to the steam inlet.

4. The dump device of claim 3 wherein each of the first and second heads includes a blank area which defines the geometric center thereof and is devoid of any of the first or second discharge holes.

5. The dump device of claim 4 wherein the blank area of each of the first and second heads has a generally circular configuration.

6. The dump device of claim 3 wherein the first and second discharge holes are evenly distributed within respective ones of the first and second heads.

7. The dump device of claim 3 wherein each of the first and second discharge holes formed in a respective one of the first and second heads has a generally circular cross-sectional configuration of a first prescribed diameter.

8. The dump device of claim 3 wherein the first discharge holes are formed in the first head and the second discharge holes are formed in the second head in prescribed geometrical patterns as further facilitates the formation of a prescribed arrangement of blank areas between the first and second discharge holes within respective ones of each of the first and second heads.

9. The dump device of claim 1 wherein the first discharge holes are formed in the first head and the second discharge holes are formed in the second head in a plurality of segregated sets which are each of a prescribed shape.

10. The dump device of claim 9 wherein the shapes of each of the sets of the first and second discharge holes formed in respective ones of the first and second heads is identical.

11. The dump device of claim 1 wherein each of the first and second heads is toriconical.

12. The dump device of claim 1 wherein each of the first and second heads is elliptical.

13. The dump device of claim 1 wherein each of the first and second heads is generally flat.

14. A low profile dump device for mounting to a duct and facilitating a discharge of steam from a steam inlet into the duct at prescribed velocities during normal operating and trip conditions of a turbine, the dump device comprising:

a first stage fluidly connectible to the steam inlet, and comprising:

a first head having a geometric center, an interior surface and an opposed exterior surface which is of a first surface area; and a multiplicity of first discharge holes disposed in the first head in a prescribed arrangement and extending therethrough between the interior and exterior surfaces thereof along respective flow axes so as to be placeable into fluid communication with the steam inlet when the first stage is connected thereto;

a second stage attached to the first stage and fluidly connectible to the duct, the second stage comprising:

a second head having a geometric center, an interior surface and an opposed exterior surface which is of a second surface area exceeding the first surface area by a prescribed percentage; and a multiplicity of second discharge holes disposed in the second head in a prescribed arrangement and extending therethrough between the interior and exterior surfaces thereof along respective flow axes so as to be in fluid communication with the first discharge holes of the first head, and placeable into fluid communication with the duct when the second stage is connected thereto;

the first and second stages being attached to each other such that the geometric centers of the first and second heads are separated from each other by a prescribed distance;

the prescribed percentage differential between the first and second surface areas and the prescribe distance between the geometric centers of the first and second heads being selected such that a steam velocity across the dump device will be subsonic during a normal operating condition of the turbine to reduce noise, and transonic during a trip condition of the turbine to prevent excessive reaction loads.

15. The dump device of claim 14 wherein the first and second discharge holes are evenly distributed within respective ones of the first and second heads.

16. The dump device of claim 14 wherein each of the first and second discharge holes formed in a respective one of the first and second heads has a generally circular cross-sectional configuration of a first prescribed diameter.

17. The dump device of claim 14 wherein a majority of the flow axes defined by the first and second discharge holes diverge from and extend in non-parallel relation to a steam inlet axis defined by the steam inlet when the dump device is attached thereto.

18. The dump device of claim 14 wherein each of the first and second heads is elliptical.

* * * * *